United States Patent [19]

Radtke

[11] 4,202,523

[45] May 13, 1980

[54] BORON NITRIDE/ELASTOMERIC POLYMER COMPOSITION FOR COATING STEEL CASTING DIES

[75] Inventor: Schrade F. Radtke, New Canaan, Conn.

[73] Assignee: International Lead Zinc Research Organization, Inc., New York, N.Y.

[21] Appl. No.: 857,939

[22] Filed: Dec. 6, 1977

Related U.S. Application Data

[63] Continuation-in-part of Ser. No. 814,536, Jul. 11, 1977, abandoned.

[51] Int. Cl.[2] ..... B22C 3/00

[52] U.S. Cl. ..... 249/115; 427/135; 106/38.25; 164/33; 164/72; 252/25

[58] Field of Search ..... 252/25; 260/998.18, 260/37 R; 427/133–135; 106/38.22, 38.25, 38.27; 249/114, 115; 264/338; 164/72, 73, 14, 123, 138

[56] References Cited

U.S. PATENT DOCUMENTS

| | | | |
|---|---|---|---|
| 3,253,932 | 5/1966 | White | 106/38.27 |
| 3,879,301 | 4/1975 | Caerns | 252/12 |
| 4,104,096 | 8/1978 | Gass | 252/12 |
| 4,119,547 | 10/1978 | Nachtman | 252/25 |
| 4,128,486 | 12/1978 | Palmer | 252/25 |

FOREIGN PATENT DOCUMENTS

| | | | |
|---|---|---|---|
| 4720568 | 9/1972 | Japan | 252/25 |

*Primary Examiner*—Sam Silverberg

*Attorney, Agent, or Firm*—Brumbaugh, Graves, Donohue & Raymond

[57] ABSTRACT

A composition and method for coating the surface of steel casting dies for molten metals are described. The composition comprises a dispersion of boron nitride powder, an elastomeric polymer and an organic solvent or diluent. The elastomeric polymer consists of two fractions, a high-polymer fraction and a low-polymer fraction. The treatment provides thermal insulation to the mold surface, thereby minimizing premature solidification of the cast metal.

15 Claims, 8 Drawing Figures

Cover

Ejector

100X Picral Etch 3J955 a. Microstructure of Casting Cross Section

500X Picral Etch 3J956 b. Microstructure Adjacent to the Cover Die Surface

FIGURE 3. TYPICAL MICROSTRUCTURES OF ZINC DIE CASTINGS (ALLOY NO. 3) PRODUCED IN A BARE-STEEL DIE

100X Picral Etch 3J960 a. Microstructure of Casting Cross Section

500X Picral Etch 3J961 b. Microstructure Adjacent to the Cover Die Surface

FIGURE 4. TYPICAL MICROSTRUCTURES OF ZINC DIE CASTINGS (ALLOY NO. 3) PRODUCED IN DIE INSERTS COATED WITH ELASTOMERIC BORON NITRIDE

Note that the coating had been removed from the ejector half of the die during the casting experiments.

BORON NITRIDE/ELASTOMERIC POLYMER COMPOSITION FOR COATING STEEL CASTING DIES

This is a continuation-in-part of my copending application Ser. No. 814,536 filed July 11, 1977, now abandoned.

The present invention relates to the casting of metals in steel casting dies. In industrial die casting processes, molten metal is injected into a cavity formed by two sections of a steel casting die wherein the molten metal is allowed to solidify into a cast metal piece. The die sections, one stationary and one movable, contain tubes for circulating water to cool the sections in order to accelerate the solidification of the molten metal. After the molten metal has solidified, the steel casting die sections are separated and the cast metal piece is ejected.

Sometimes, molten metal freezes too rapidly, especially in thin sections of the die. One of the undesirable effects caused by molten metals freezing too rapidly in the die cavity is the problem of "cold shuts" (i.e. obstruction of the flow of molten metal in the die by premature solidification, usually in the thin section of the die,) in which the metal solidifies prematurely thereby preventing complete filling of the die cavity. Also the metal may exhibit a patterned, rather than a smooth, surface on the piece. After extended use, the elevated temperatures and pressures involved in die casting processes can damage the steel casting dies and cause surface imperfections in the cast piece. In addition, fusion or sticking of the molten metal to the steel casting die surface can occur unless the die surface is first treated with a lubricant, antisticking agent or mold release composition.

As reported in Metals Handbook, the production of castings having thin sections presents problems in many cases because of temperature considerations. The temperature at which a die will operate during continuous operation depends on the weight of the "shot," the surface area of the shot, the cycle speed, and the shape of the die. When dies are too cold, cold shuts, laminations, internal incomplete filling and poor finishes with excessive flow marks are likely to result.

Cold shuts or flow marks in zinc alloy die castings also occur when the sprays of molten metal that first contact the surface of the die harden and are not remelted by the heat of the metal that later enters and fills the die cavity. The sprayed metal shows on the surface of the casting as laps or layers or as partly melted pieces embedded in the casting, or the cast part is incompletely formed due to incomplete filling of the die.

Some casting shapes require localized heating above the established temperature. Metal overflows are often used to heat die areas surrounding peripheries having thin sections far from the main runner. This method of local heating helps to fill thin sections and to improve casting finish. In the past, cold shuts have been eliminated by decreasing the cycle time to increase the die temperature; or by reducing coolant flow in the area of the die corresponding to the affected area of the casting; or by heating the die with external heaters.

Depending upon the particular conditions, the minimum thickness that can be produced in a zinc die casting is of the order of about 0.01 in., usually around 0.02 to 0.03 in. As suggested above, the minimum thickness which can be tolerated is also a function of the physical size of the casting and other variables as well. It is castings or such thin sections to which one object of the present invention is directed because the thermal insulation provided by the die coatings of the present invention permits the use of thin sections while still avoiding the disadvantages of premature solidification of the molten metal, and avoiding the need for unusual measures such as extra heaters or die overflowing to avoid the cold shuts, etc. For example use of the present invention permits the flow of molten metal into areas having constricted cross-sections such as automotive radiator grills.

In the past, boron nitride has been used as a lubricant for industrial machinery because of its high temperature stability and thermal insulation properties. When used alone, however, boron nitride does not adhere effectively to the die surface, and it has been necessary to disperse it as a powder in a suitable carrier. In this regard, U.S. Pat. No. 2,726,160 describes a composition of boron nitride in water using an acetate of an acylated diamine as a dispersing agent. According to the patent, the composition is applied as a thin coating on casting molds for glass and metal. The coating is not expected to provide continuous protection for the mold and must be reapplied every several hours.

Various polymers have also been used as lubricants in the die casting of metals. When used alone, many polymers decompose, emit noxious fumes, or become tacky upon contact with molten metals. U.S. Pat. No. 2,923,041 relates to the treatment of metal casting molds for non-ferrous metals using low molecular weight hydrocarbon polymers, such as polyisobutylenes and polyethylene. Alpha-olefinic polymers in organic diluents, including ketones, toluene and benzene, are disclosed in U.S. Pat. No. 3,253,932. Polyol esters of fatty acids are described as liquid lubricants in U.S. Pat. No. 3,620,290.

Other known coating compositions for coating metal casting molds include molybdenum disulfide in a polymer base as described in U.S. Pat. No. 3,447,588. A mixture of graphite, cryolite and a boron-containing compound for protecting the surface of a metal is described in U.S. Pat. No. 3,685,986. The boron-containing compound is either boron anhydride or boron ore. Casting molds containing silicon nitride are described in U.S. Pat. No. 3,709,459. In U.S. Pat. No. 3,727,666, a thin refractory composition, which may contain up to 5% of a water-based latex is used to prevent contamination of the molten metal and sticking of the metal at the casting mold surface. Finally, a coating of an inorganic binder and a metallic material or a solid lubricant for treating die surfaces is disclosed in U.S. Pat. No. 3,895,899. The patent describes the formation of a layer of nitride and borides as diffusion products which result from the simultaneous penetration of nitrogen and boron into the working surfaces of the mold.

Moreoever, the foregoing prior art does not suggest any solution to the problem of premature solidification or "cold shuts" in die casting.

SUMMARY OF THE INVENTION

A method and a composition for coating steel casting dies for molten metal has now been discovered. The coating provides thermal insulation and lubricity and protects the die surface, thereby overcoming the disadvantageous effects on the die surface and cast metal noted above. In the present invention, the surface of a steel casting die is coated with a novel composition comprising a uniform dispersion of boron nitride powder, an elastomeric polymer having a high- and a low-polymer fraction, and an organic solvent or diluent for the polymer. The dispersion is applied as a thin film to the die surface which contacts the molten metal. The film is allowed to dry to form a thermally insulating and protective coating on the die surface.

The elastomeric polymer consists of two phases, a high-polymer fraction and a low-polymer fraction. The high-polymer fraction, which is soluble in benzene but is not soluble in acetone, provides heat resistance. The low-polymer fraction, which is soluble in both benzene and acetone, permits the boron nitride powder to be readily and completely dispersed throughout the elastomeric polymer and the organic solvent or diluent. Suitable elastomeric polymers include natural and synthetic rubbers, styrene-butadiene rubber, butyl rubber, synthetic polyisoprene, polybutadiene rubber, chlorosulfonated polyethylene, polyacrylic rubber, nitrile rubber, polyurethane rubber and mixtures thereof.

Any suitable organic solvent or diluent for the specific elastomeric polymer may be used to form a solution or fluid mixture in which the boron nitride powder is dispersed.

In a preferred embodiment, boron nitride powder is pre-coated with a solution of de-oiled lecithin in an organic solvent to minimize premature settling of boron nitride particles in the fluid mixture of the elastomeric polymer and solvent or diluent.

DETAILED DESCRIPTION OF THE INVENTION

In accordance with the invention, a composition for coating steel casting die surfaces for molten metals comprising a uniform dispersion of boron nitride powder, an elastomeric polymer having a high-polymer and a low-polymer fraction, and a solvent or diluent for the polymer is prepared. The composition may be prepared by first mixing the elastomeric polymer in a suitable solvent or diluent for the polymer and then adding boron nitride powder to the resulting mixture. Alternatively, the three components, elastomeric polymer, solvent or diluent, and boron nitride powder, may be combined at the same time, or the boron nitride powder may be first dispersed in part of the solvent or diluent and then added to the elastomeric polymer and solvent mixture. The composition is stirred or ballmilled for a sufficient time to obtain a uniform dispersion. The resulting dispersion is then applied as a thin film to the surface of a steel casting die which contacts the molten metal and permitted to dry at either room or elevated temperature, thus forming a thermally insulating, and protective coating on the die surface.

Figures 1A, 1B:
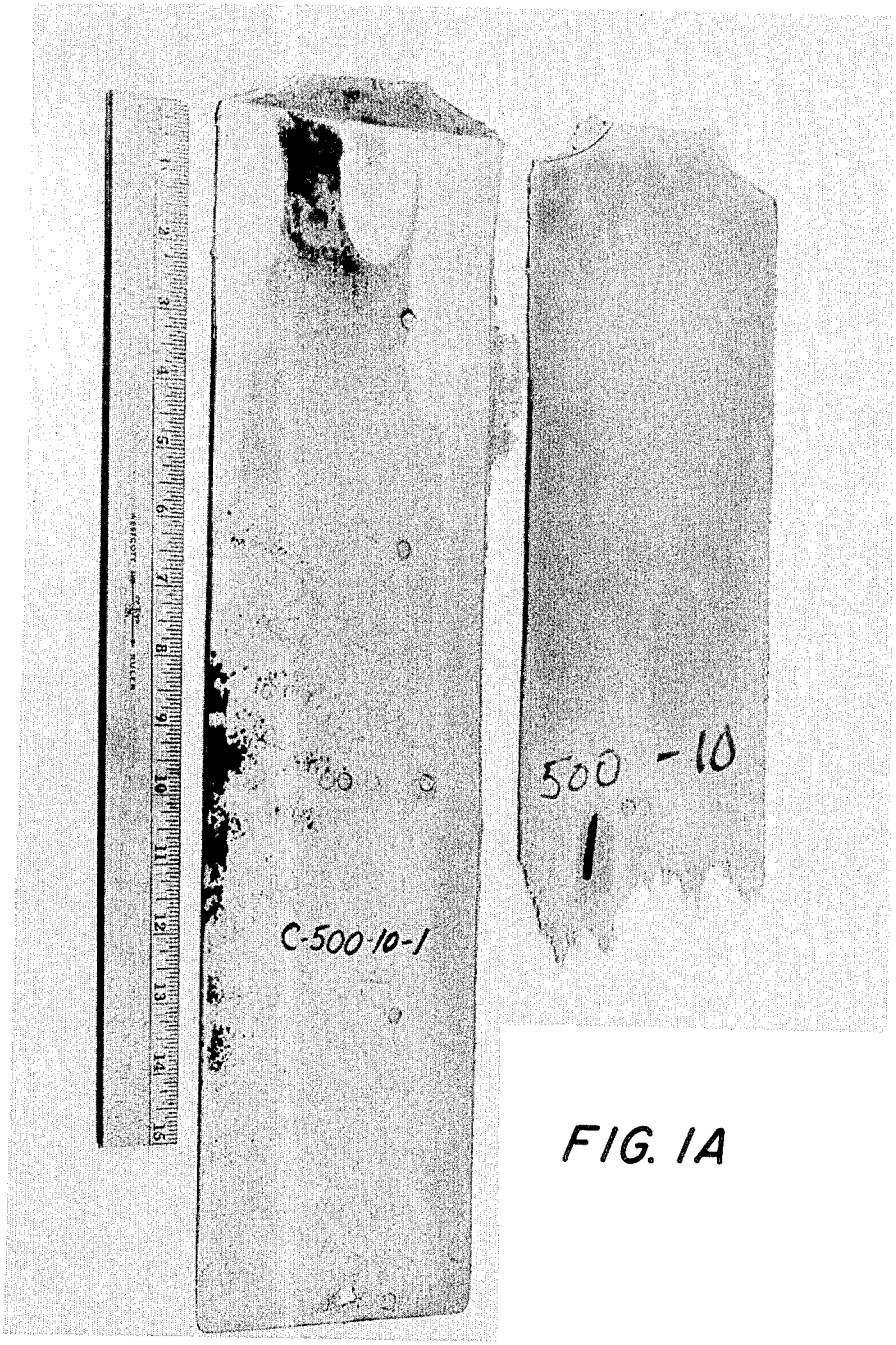
FIG. 1A shows a casting produced in an uncoated die.
FIG. 1B shows a casting produced in a die coated in accordance with the present invention.

The final product is a coated casting die for molten metals having a uniform coating on the die surface which contacts the molten metal. The coating composition comprises a dispersion of boron nitride powder and an elastomeric polymer having a high-polymer and a low-polymer fraction. Although casting dies are typically made of steel, the coating composition may be applied to the surface of any casting die in which the premature solidification or the high temperatures of the molten metal may result in the undesirable effects mentioned above. The coating composition may be employed to improve the finish of any metal or metal alloy. Preferably, the composition is used to coat the surfaces of steel dies used in the casting of zinc and zinc alloys.

Boron nitride, which has the chemical formula BN, is combined as a powder with the elastomeric polymer and solvent or diluent for the polymer. Preferably, the boron nitride powder should be about 90% and 100% pure. However, variations in plurity do not affect the usefulness of the invention as long as the boron nitride powder exhibits the general properties of the compound, such as heat resistance and lubricity. The particle size of the boron nitride powder in the dispersion should be less than about 200 mesh.

An elastomeric polymer, known also as an elastomer or an unvulcanized rubber, may be defined as a polymer which has the properties of natural and synthetic rubbers. Such polymers are well known in the rubber industry, and thin sections are characterized in that they stretch under tension, have a high tensile strength, retract rapidly, and return approximately to their original shape and dimensions.

As stated above, the elastomeric polymer as used in the present invention must consist of both a high-polymer and a low-polymer fraction. The high-polymer fraction provides heat resistance for the coating, and the low-polymer fraction permits the boron nitride powder to be evenly and completely dispersed in the mixture of polymer and solvent.

By way of explanation, releases from elastomeric polymers immersed in organic solvents are a function of the low-polymer fraction. Such compounds are formed by the development of a high-polymer fraction within an initial low-polymer fluid which represents the monomer form or its minor modifications and remains present in the polymer material even when other fractions have already progressed in the polymer material even when other fractions have already progressed to a higher polymer form. Such formations are referred to as "heterophase polymer materials." These polymer formations with their fluid fraction occur in nature as well as in synthetic materials. The starting material is molecularly dispersible or "soluble," and the developing polymer matter is no longer molecularly dispersible or soluble and is capable of increasing its volume in contact with the liquid organic solvent. Although both fractions give the appearance of a uniform material, they consist of more than one phase, each of which participates in the development of the characteristics of the polymer. The heterophase polymeric materials are described in Kronstein, M., "Function of Low Polymer Fractions in Releases from Polymer Materials", *ACS Symposium Series* 33, D. R. Paul and F. W. Harris, Eds., Washington, D.C. (1976). For an explanation of the diverse nature of polymers, reference is also made to the Intrinsic Properties of Polymers by A. R. H. Tawn, Marcel Dekker, New York 1969, pages 12–17.

The following elastomeric polymers may be used to prepare the coating of the present invention: natural and synthetic rubbers, styrene butadiene rubber, butyl rubber, synthetic polyisoprene, polybutadiene rubbers, chlorosulfonated polyethylene, polyacrylic rubber, nitrile rubber, polyurethane rubber, and mixtures thereof. Such elastomers and their properties are further described in G. G. Winspear ed., *The Vanderbilt Rubber Handbook, R. T. Vanderbilt Co., Inc., New York* (1968).

The organic solvent or diluent for the elastomeric polymer may be selected from the group of suitable aliphatic and aromatic compounds which disperse the particular elastomeric polymer used into a solution or fluid mixture. Any solvent which is capable of dispersing both the high-polymer and low-polymer fractions may be employed. Such solvents are well known in the rubber industry, and suitable solvents for specific polymers are listed in A. K. Doolittle, *Technology of Solvents and Plasticizers,* John Wiley Sons, Inc., New York (1954). The preferred solvents are benzene, toluene, xylene, methylethylketone, methylisobutylketone, acetone and mixtures thereof.

For the present invention, the boron nitride powder and elastomeric polymer may be combined in the following amounts by weight: about 1 to 2 parts boron nitride to about 1 to 3 parts elastomeric polymer. The amount of solvent or diluent will vary according to the elastomeric polymer selected. One skilled in the art could readily determine the appropriate amount of solvent or diluent which would provide a uniform dispersion. Typically, the amount of solvent suitable for the preceding amounts of boron and nitride and polymer would range from about 6 to 16 parts by weight.

After combining the boron nitride powder, elastomeric polymer and solvent or diluent for the polymer, the mixture is stirred, shaken or ballmilled for a sufficient length of time to form a uniform dispersion. Ballmilling involves agitating the mixtures in the presence of non-reactive abrasive particles, such as ceramics of steel balls. In has been found that a uniform dispersion can be obtained when the mixture is ballmilled for about one to two hours. Longer ballmilling times, such as twelve hours, do not adversely affect the dispersion and may improve the uniformity of the final dispersion.

The dispersion is then applied as a thin film on the surface of a steel casting die which contacts molten metal by any suitable method, such as brushing or spraying. To facilitate application, the dispersion may be further diluted with an appropriate volatile solvent. The dispersion is allowed to dry forming a coating covering the entire surface of the casting die. The drying time depends on the elastomeric polymer, the solvent or diluent used, and the external temperature conditions. The thickness of the dry coating per application should range from about 0.2 to 4.0 mils (about 5 to 100 microns). The coating thickness may be increased by multiple applications of the dispersion after the preceding layer has dried.

In a preferred embodiment, boron nitride powder is pre-coated with a solution of de-oiled lecithin in an organic solvent. De-oiled lecithin is prepared by adding acetone to soybean lecithin, which contains an "oil-carrier" fraction, to produce lecithin containing about 0% to 4% oil. The "oil-carrier" fraction is extracted with the acetone leaving the de-oiled lecithin. A 10% solution of the de-oiled lecithin in an organic solvent, such as toluene, xylene or mineral spirits is then used to precoat the boron nitride particles. The precoated boron nitride particles are then dispersed throughout the mixture of elastomeric polymer and solvent or diluent as described above. The procedure minimizes premature settling of the boron nitride particles and thereby eliminates the need to shake the coating composition to assure that the dispersion is uniform. The advantageous properties of thermal insulation and lubricity are also exhibited using the coating of the preferred embodiment.

The following examples are submitted to illustrate, but not to limit, the invention of coating metal casting dies with a composition comprising a dispersion of boron nitride powder, elastomeric polymer, and solvent or diluent for the polymer.

EXAMPLE I

To demonstrate the effectiveness of coating steel casting dies with the composition of the present application, the following tests were performed. Boron nitride/elastomeric polymer compositions according to the invention were compared with elastomeric polymer solutions which contained no boron nitride. In each case, an elastomeric polymer solution was prepared according to the formulations given below. The elastomeric polymer solution was divided with one part being applied directly to a steel panel as a thin coating and allowed to dry as a control. To the other part of solution, boron nitride powder was added and the resulting composition was ballmilled until a uniform dispersion was obtained. As with the elastomeric polymer solution, the composition with boron nitride was coated on an identical steel panel and the coating was allowed to dry.

For the tests, carbon steel panels (0.032 inch thick) were coated either with the elastomeric polymer solution alone as a control, or with the boron nitride/elastomeric polymer composition according to the invention. The panels were coated with a thin layer of either the control or invention coating. After the coatings dried, the layer thickness was determined with a microtest gage.

Zinc bars were melted in covered crucibles to minimize zinc oxide formation and then poured on the coated steel panels in drops measuring approximately 5 mm deep. The molten zinc was allowed to cool and solidify on the coated panels. The cooling times were similar to those required in commercial casting procedures.

Table I lists the amounts of the components of the coating compositions using various polymers prepared according to the procedure described above. For each comparison, an elastomeric polymer control solution was prepared and coated directly on one or more steel panels. The invention composition was ballmilled until a smooth dispersion was obtained and then applied to one or more panels. The coatings were applied to the panels and allowed to dry. Thereafter, molten zinc was dropped on the coated panels.

TABLE I

| Coating | Amount |
|---|---|
| A. Styrene-butadiene-styrene polymer | |
| 1. polymer | 66 g |
| toluene | 33 g |

TABLE I-continued

| Coating | Amount |
|---|---|
| 2. polymer (25% polymer in toluene) | 66 g |
| toluene | 33 g |
| boron nitride powder | 15 g |
| toluene | 25 g |
| B. Natural crepe rubber (7.5% rubber solution) | |
| 1. rubber | 37 g |
| petroleum naphtha | 113 g |
| toluene | 250 g |
| methyl isobutyl ketone | 100 g |
| 2. the 7.5% rubber solution of B.1. | 140 g |
| methylisobutyl ketone | 25 g |
| boron nitride | 15 g |
| C. Nitrile rubber | |
| 1. 42.5% nitrile rubber in toluene | 55 g |
| toluene | 25 g |
| 2. 42.5% rubber in toluene | 55 g |
| toluene | 25 g |
| boron nitride | 15 g |
| 10% de-oiled lecithin in toluene | 5 g |
| toluene | 10 g |
| D. Polyurethane rubber | |
| 1. polymer | 117 g |
| acetone | 83 g |
| 2. polyurethane/acetone solution of D.1. | 50 g |
| boron nitride | 15 g |
| 10% de-oiled lecithin in toluene | 5 g |
| toluene | 10 g |
| acetone | 30 g |

TPLA, and warming the mixture with stirring until the mixture reached 100° C. The composition was then diluted with toluene to form a 25% solution. This solution was found to dry on the steel panels in several hours at room temperature. The solution was used in the formulations below:

| | |
|---|---|
| E. Polyurethane/TPLA in toluene | |
| 1. polymer solution applied as described above | 70 g |
| 2. polyurethane/TPLA in toluene | 70 g |
| toluene | 15 g |
| boron nitride | 15 g |
| 10% de-oiled lecithin in toluene | 4 g |
| toluene | 45 g |

Table II gives the thickness readings for the above coatings on steel panels before and after molten zinc was applied, and the % loss in coating thickness with respect to the two readings. The panel numbers correspond to the compositions described above. The thickness readings, which are given in mils (1 mil=0.001 inch), were made using a microtest gage. Three readings were taken for each panel and averaged. The difference in coating thickness after zinc was applied was determined and the % loss in coating thickness calculated therefrom.

TABLE II

| Panel No. | Thickness of Coating Before Molten Zinc Applied | Thickness After Zinc Solidified | % Loss |
|---|---|---|---|
| A. Styrene-butadiene-styrene | | | |
| 1. Control | 1.90 | zinc fused to metal | |
| | 2.10 | zinc fused to metal | |
| 2. Invention | 1.61 | 1.16 | 27 |
| | 1.40 | 1.32 | 6 |
| | 1.86 | 1.40 | 24.5 |
| B. Natural Crepe Rubber | | | |
| 1. Control | 0.28 | 0.03 | 89 |
| | 0.38 | 0.13 | 70 |
| 2. Invention | 2.22 | 1.90 | 14.4 |
| | 1.46 | 1.33 | 9 |
| | 1.25 | 1.01 | 19 |
| C. Nitrile Rubber | | | |
| 1. Control | sticky (no readings) | 0.18 zinc adhered to panel | |
| 2. Invention | sticky (no readings) | 0.17 | |
| D. Polyurethane Rubber | | | |
| 1. Control | 0.80 | zinc fused to panel too sticky | |
| | 1.20 | | |
| 2. Invention | 1.33 | 1.04 | 21.8 |
| | 1.83 | 1.19 | 35 |
| | 2.17 | 1.67 | 23 |
| E. Polyurethane/TPLA | | | |
| 1. Control | 0.32 | 0.18 | 44.8 |
| | 0.30 | zinc fused to panel | |
| 2. Invention | 0.44 | 0.10 | 75 |
| | 0.28 | 0.24 | 15 |
| | 0.33 | 0.21 | 38 |

The nitrile rubber and polyurethane rubber of C. and D. did not dry readily at room temperature. It was found that drying did occur when the panels were placed in an oven at a temperature maintained in the range 82°-93° C. (180°-200° F.). When molten zinc was applied, the metal fused to the still sticky panels which did not have boron nitride, but did not adhere to the panels according to the invention.

To overcome the above drying problem, triphenylleadacetate (TPLA) was added to a polyurethane rubber solution by mixing 45 g of polyurethane and 3.5 g of The results in Table II demonstrate the superiority of the coating containing boron nitride powder as compared with the coating of elastomeric polymer solution alone. As can be seen from the data, the polymer solution coating is unsuitable in that the solid zinc metal fused or stuck to the steel panel and the coating itself melted or dissolved under the hot molten zinc leaving no coating on the panel. In contrast, the coatings containing boron nitride did not melt or dissolve and the zinc did not adhere to the steel panels coated with the invention composition.

To summarize, the tests show that the elastomeric polymer solutions containing the boron nitride gave excellent results, whereas the control solutions without boron nitride were unsatisfactory as coatings. The four polymers tested were styrene-butadiene-styrene polymer (A), natural crepe rubber (B), nitrile rubber (C), and polyurethane rubber (D, E). Furthermore, the tests show that the elastomeric polymer may be dissolved in a single solvent as in A or in a mixture of solvents as in B. The optional embodiment of initially coating the boron nitride powder with oil-free lecithin is illustrated in C with similar results. Finally, D and E show that the drying times for the coating may be speeded up by adding triphenylleadacetate to an elastomeric polymer solution and heating the composition.

EXAMPLE II

The procedure described in Example I was used to prepare polyisoprene coatings with the following formulations:

TABLE III

| Coating | Amount |
|---|---|
| A. Polyisoprene | |
| 1. 12.5% polyisoprene in toluene | 120 g |
| methylethylketone | 33 g |
| 2. 12.5% polyisoprene in toluene | 120 g |
| methylethylketone | 33 g |
| boron nitride | 15 g |
| 10% de-oiled lecithin in toluene | 4 g |
| methylethylketone | 10 g |

Two steel panels were coated with the polyisoprene solution alone and three panels were coated with the solution containing boron nitride. Molten zinc was dropped on the coated panels. On one panel with the elastomeric polymer control coating, the coating under the molten zinc melted, and after the solid zinc was removed, the coating was found to adhere to the reverse side of the cast zinc. With the other control panel, the solid zinc fused to the coated panel. When the zinc drop was removed from the panel, it was observed that there was no coating left on the panel. For the panels having the boron nitride/polysioprene coating of the invention, the coatings did not melt or give off vapors of decomposition. Furthermore, the cooled solid zinc metal did not stick to the panel with the invention coating.

EXAMPLE III

In another test, a mixture of elastomers in solution was used instead of a single elastomer in solution. Both a control and an invention composition were prepared. A solution containing three different elastomeric polymers and a hardening agent was prepared. The mixture was composed of 6.3 parts by weight of 12.5% polyisoprene in toluene, 3 parts by weight 12% chlorosulfonated polyethylene in benzene, 1 part styrene-butadiene-styrene polymer (25%) in 1.7 parts polyamide polymer resin (25% dispersion in 70% benzene and 30% propanol). The polyamide polymer resin is a hardening agent. The formulations were prepared as shown in Table IV:

TABLE IV

| Coating | Amount |
|---|---|
| A. Four-component mixture | |
| 1. elastomeric polymers in solution | 120 g |

TABLE IV-continued

| Coating | Amount |
|---|---|
| methylethylketone | 33 g |
| 2. elastomeric polymer in solution | 120 g |
| methylethylketone | 33 g |
| boron nitride | 15 g |
| 10% de-oiled lecithin in toluene | 4 g |
| methylethylketone | 10 g |

Steel panels were coated as described in Example I with the four-component elastomeric polymer solution and with the boron nitride/elastomeric polymer solution. The coating melted and smoke evolved when the molten zinc was added to the coating having no boron nitride. On cooling, the zinc fused to the steel panel surface as the film beneath the melt had burned away. With the invention coating, some smoke was given off when zinc was dropped on the panel. The coating beneath the zinc became discolored but did not melt. The slight decomposition with the coating according to the invention was attributed to the polyamide resin component, not the elastomers. This was confirmed by preparing and testing a three-component solution consisting of the elastomers in the following amounts: 6.3 parts by weight 12.5% polyisoprene in toluene; 3 parts by weight 12% chlorosulfonated polyethylene in benzene; and 1 part 25% styrene-butadiene-styrene polymer in toluene. No polyamide polymer resin was added.

Again, steel panels were coated with the solutions having the formulation. On applying molten zinc, the coating containing no boron nitride did not melt completely; however, the cooled zinc drop stuck to the panel surface. As for the invention coating with boron nitride, the zinc did not stick to the panel. Slight discoloration of the panel was observed.

EXAMPLE IV

A concentrated form of the composition was prepared using a three component elastomeric polymer system. Such a composition can be prepared and stored for later dilution immediately prior to application. The formulations were prepared as shown in TABLE V.

TABLE V

| Coating | Amount |
|---|---|
| A. Three-component mixture | |
| 1. elastomeric polymers comprising | |
| a. polyisoprene (12.5% in toluene) | 294 g |
| b. chlorosulfonated polyethylene (12% in benzene) | 140 g |
| c. styrene-butadiene-styrene (25% in benzene) | 46 g |
| 2. boron nitride dispersion comprising | |
| a. boron nitride | 65.5 g |
| b. lecithin granules (10% in toluene) | 16 g |
| c. methyl ethyl ketone | 30 g |
| elastomeric polymer mixture as in A.1. | 480 g |
| additional methyl ethyl ketone | 132 g |

In this example, the boron nitride dispersion of the invention was first ballmilled and then mixed with the three-component elastomeric polymer solution. Finally, the composition was further diluted with methylethylketone.

Steel panels were again coated with the elastomeric polymer solution alone as a control and with the composition containing boron nitride. After the coating dried, molten zinc was poured on the panels as in the previous examples. The coatings without boron nitride melted partially and the cooled zinc metal adhered to the panel surface. With the invention formulated, the panels showed only slight discoloration and the zinc did not stick to the panels. The thickness readings of the coating before and after zinc was applied were taken with a microtest gage. The results are reported in TABLE VI.

TABLE VI

| Panel No. | Thickness of Coating Before Molten Zinc Applied | Thickness After Zinc Cooled | % Loss |
|---|---|---|---|
| 1. Control Zinc adhered to panel | 0.58 | 0.08 | 86 |
| 2. Invention | 2.51 | 1.40 | 44 |
| | 1.37 | 1.30 | 5 |
| | 2.56 | 2.30 | 10 |

The above tests demonstrate the superiority of the coatings according to the invention. The elastomeric polymer control solution dried with a residual tackiness, with a film that softened readily when contacted with hot molten zinc. When small drops of the molten zinc cooled, they fused to the coating on the panel. Large drops of molten zinc, which cool more slowly due to their larger volume, caused the control layer to smoke and burn emitting noxious fumes. The coating at the site of the molten zinc had burned away in many instances. The coatings of the invention with boron nitride, however, did not exhibit residual tackiness and did not smoke when contacted with molten zinc. Furthermore, the solid zinc metal did not adhere to the steel panels coated with the composition of the present invention.

EXAMPLE V

Two carbon steel panels (Q panels type R36; 0.032 in. thick) were coated with a composition which was a dispersion of HCP grade boron nitride (Union Carbide Corporation, HCP Powder, (No. H3250)) in an elastomeric polymer adhesive which has a synthetic rubber base of styrene-butadiene rubber in trichloroethylene solvent supplied by 3M Company and designated "Scotch-Grip Insulation Adhesive (clear) No. 34". The elastomeric polymer was composed of high polymer and low polymer fractions. The composition was prepared as follows:

Oil-free lecithin was first prepared by treating commercial lecithin containing its natural oils produced from soybean seed, with acetone. In this way the oil components were removed with the acetone and separated from the dry lecithin. Such materials are available, for instance as "Alcolec" lecithin granules of the American Lecithin Company. The oil-free lecithin was dissolved in toluene as 10 parts by weight lecithin to 90 parts toluene. The boron nitride was then treated with the lecithin solution by mixing 90 parts by weight of BN with 30 parts of the 10% lecithin-toluene solution and 70 parts methylethyl ketone and ballmilling the mixture for a few hours. The 190 parts of pigment-solvent paste was then mixed with 100 parts of diluent such as methyl-ethyl ketone and introduced into 300 parts of the 3M adhesive referred to above. The elastomeric polymer composition (300 parts) contained 30% by weight of solids (90 parts of elastomeric polymer) so that there was a 1:1 ratio on solids basis of BN to elastomeric polymer. The resulting composition was further diluted with 200 parts of diluent (MEK and toluene 1:1). The coating composition was then applied by pouring it over the steel panels. The BN pigmentation did not tend to separate or flow off the surface of the panel as reported in EXAMPLE VI, which follows, where no lecithin was used. It was adherent and non-tacky. The panel was set over a sheet of paper toweling in order to study how far the heat of the applied metal melt would penetrate through the steel panel and to observe whether it would cause a "burn" on the paper. Molten zinc was then poured onto the panel to a layer thickness of 5 mm. The backside of the steel panel was browned but not blackened. There were some markings on the paper but it was not burned.

The foregoing procedure was also carried out using HCV boron nitride, with substantially the same results except that the HCV coatings appeared smoother and transmitted more heat than the HCP formulations. The coatings, however, were non-tacky, non-smoking, prevented sticking of the molten metal to the steel panel, and prevented burning or charring of the paper underneath the steel panel. Following is a table giving the properties of the boron nitride used.

| HCP | | HCV |
|---|---|---|
| 99% B + N | 95% B + nitride | |
| max. oxygen | 0.5% | 3.5% |
| max. carbon | 0.4% | 0.4% |
| max. other impurities | 0.1% | 0.1% |
| max. $H_2O$ | — | 1.0% |
| Screen Analysis % thru 325 mesh | 94.5% | 98.5% |

In comparison with the foregoing tests, a similar carbon steel panel was coated with the same 3M Insulation Adhesive No. 34 but without the BN pigment addition. It had been diluted with 20% methyl-ethyl ketone before applying to make it pourable. The coatings remained tacky after drying, and when molten zinc was poured onto them according to the procedure described above, dense smoke was formed the coatings became charring and the zinc after solidification stuck to the steel panel. Such coatings, therefore, would be unsuitable for treating the internal surfaces of dies for lubricating or heat insulation purposes.

EXAMPLE VI

Three carbon steel panels (Q Panels, Type R36) were coated with 3M Insulation Adhesive No. 34 pigmented with type HCP boron nitride, prepared by ballmilling for three hours a mixture of 60 parts pigment, 70 parts adhesive, and 100 parts MEK. The first panel was coated by pouring the above mixture onto the panel; the second panel was coated with a mixture of 20 parts of the above HCP formulation with 180 parts MEK (1:10 dilution); and the third panel was coated with a mixture containing two parts of the initial product with 198 parts MEK (1:100 dilution). Each panel was immersed for one hour in a pot of molten zinc at a temperature of 825° F. The coatings were non-tacky, non-smoking, adherent, and non-wetting (the zinc did not stick to the steel panel). However, with decreasing concentration, the pigmentation tended to flow off the surface of the panel, indicating the need for improved dispersion of the pigment in the adhesive binder.

EXAMPLE VII

The process of Example V was repeated, using a solution of the BN pigmented adhesive which had been diluted with an equal volume of a mixture of toluene and MEK. After applying the molten zinc, the coatings were adherent, non-tacky, non-smoking, and prevented adherence of the molten zinc to the steel panels. The panel which was treated with the composition containing the HCP type of boron nitride showed a more intense coating discoloration underneath the 5 mm thick molten zinc. The reverse side of the steel panel showed a dark marking but there were no burn markings on the paper. The panel treated with the HCV type of boron nitride showed a darker discoloration underneath the 5 mm thick applied molten zinc. The backside of the panel was darkened also but the paper underneath was not burned.

EXAMPLE VIII

The elastomeric coating mix which was prepared according to Example IV and was applied to the steel panels as described in that example, was thinned by mixing equal volumes of the mix and xylene and was then applied to the internal surfaces of a steel mold cavity which was 0.025 in. thick, 18 in.long and 5 in. wide. The coating was applied with an artist's air brush. Successive coatings were sprayed onto the cavity surfaces until the coating thickness was about 0.0025" on each die half. In order to avoid uneven areas in the coating, the air stream from a fan was directed such that the floc on strings were blown away from the die surface. This technique eliminated much of the roughness in the coating surface. After the cavity had been coated, the die was heated at 500° F. and held at that temperature for approximately 10 hrs. to cure the coating. Zinc castings were produced with the coated die at 500° F.; the metal temperature in the holding furnace was 800° F. The initial castings were produced at a metal flow rate of about 400 cu. in. per sec. (gate velocity of 266 ft. per sec.). Subsequently, the flow rate was reduced progressively to 80 cu. in. per sec. (gate velocity of 53 ft. per sec.). During the casting runs no lubricant was applied directly to the coated cavity surfaces; however, the runner and ejector pins were lubricated after 25 shots.

Similar coatings were made in the same mold but without the coatings having been applied to the internal mold surfaces.

The first and 50th castings produced in the coated cavity and in the cavity without coating are shown in FIGS. 1A, 1B, 2A and 2B. FIG. 1A shows the first "shot" castings produced in the uncoated die. FIG. 1B shows the casting produced in the die coated with the elastomer and boron nitride. The dark areas on the casting produced in the coated cavity are areas where the die coating adhered to the casting. As shown in the figures, the metal flow distance in the coated cavity was approximately 40% greater than that in the uncoated cavity. Such increase metal flow distance was observed at all of the metal flow rates which were studied. The improvement was due to the greater thermal insulation afforded by the presence of the boron nitride elastomeric coating on the die surface.

Figure 2A:
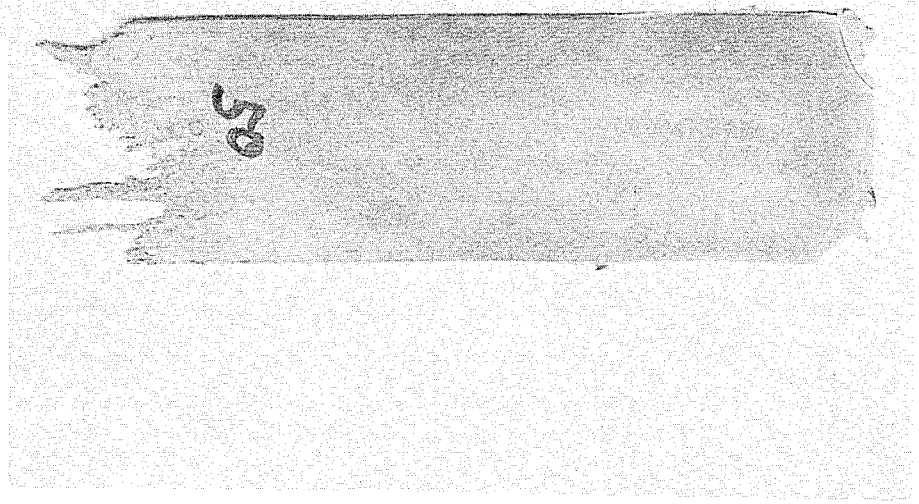
FIG. 2A shows another casting produced in an uncoated die in the 50th "shot;"
Figure 2B:
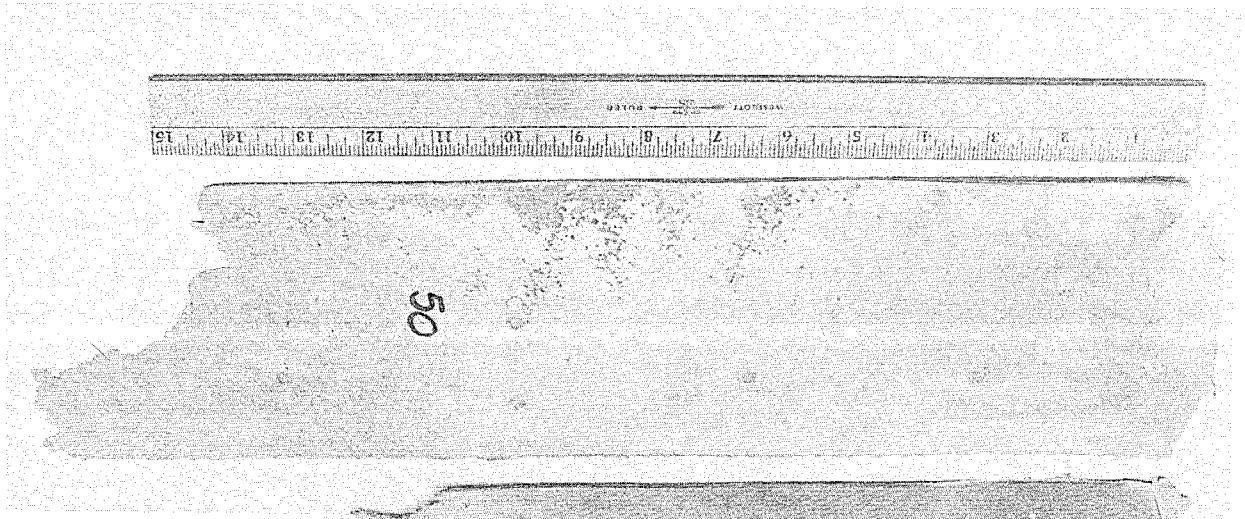
FIG. 2B shows a casting produced in a die coated in accordance with the present invention in the 50th "shot;"

FIG. 2A shows the zinc casting produced in the uncoated die in the 50th casting. FIG. 2B shows a similar casting produced in the coated die in the 50th casting. Here again, the metal flow distance in the coated cavity was approximately 40% greater than that in the uncoated cavity, the improvement being due to the thermal insulation provided by the boron nitride elastomeric coating.

It will be observed that the casting shown in FIG. 1B is better than that shown in FIG. 2B, the former being the first and the latter the 50th casting produced. The inferior nature of the later casting may have been caused by the high metal velocity used to produce the initial castings. Since the gate velocity of 266 ft. per sec. was approximately double the normal gate velocity of about 120 ft. per sec. reported for commercial die casting conditions, more normal gate velocities would probably have produced better die casting performance.

FIGS. 3A, 3B, 4A and 4B shows the differences in the micro structures between the zinc diecastings which are cast in bare steel die inserts, and others which are cast in the same die inserts which had been coated with the composition according to the present invention. All the castings were produced at a bulk-die temperature of 500° F. The 50th shot from each casting run was prepared for this evaluation of micro structures. The sections which were examined from each casting were located about 1.5 inches from the in gate.

Figure 3A:
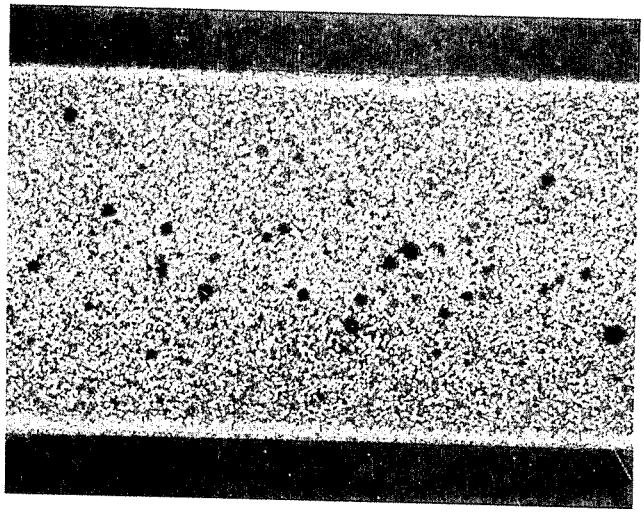
FIG. 3A is a photomicrograph of a zinc alloy casting produced in an uncoated die.
Figure 3B:
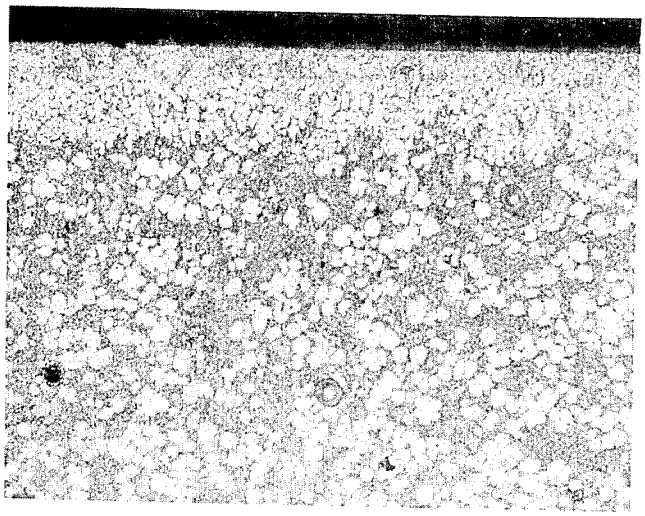
FIG. 3B is an enlarged photomicrograph of the portion of FIG. 3A which is adjacent the cover die surface.

FIGS. 3A and 3B show the micro structure of the castings produced in bare steel inserts at two different magnifications. FIG. 3A shows the casting cross section at 100X. At the surfaces of the casting were relatively thin chilled zones with a columnar grain structure. Below those regions, the bulk of the casting exhibited a more equiaxed structure that consisted of grains of the zinc-rich terminal solid solution (the light-etching phase) surrounded by the darker etching Al+Zn eutectic structure. Those microstructural features are better illustrated in FIG. 3B which shows the structure adjacent to the cover half of the die at a magnification of 500×.

Figure 4A:
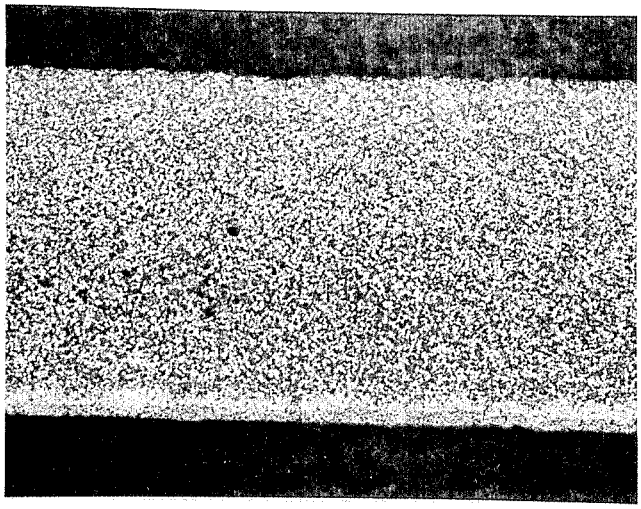
FIG. 4A is a photomicrograph of the same zinc alloy cast in a mold which had been coated in accordance with the present invention.
Figure 4B:
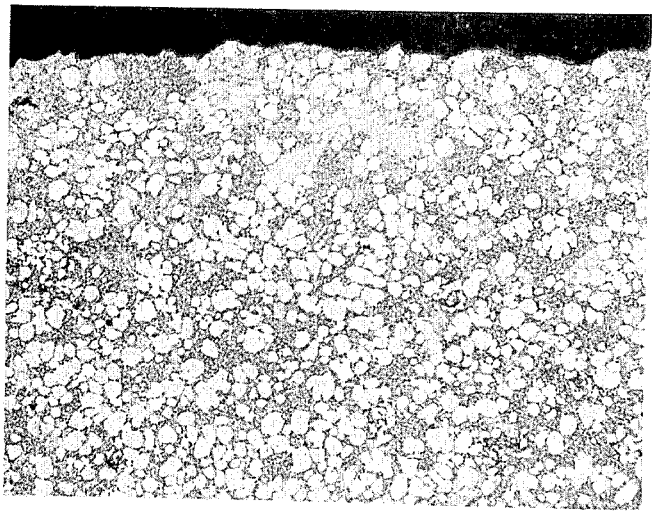
FIG. 4B is an enlarged photomicrograph of the portion of FIG. 4A which is adjacent the cover die surface.

FIGS. 4A and 4B show the microstructure of the casting produced in the elastomeric boron nitride-coated die in accordance with the present invention. By the time the 50th shot was made, essentially all of the coating had been removed from the ejector half of the die. Thus, as shown in FIG. 4A, the microstructure of the casting adjacent to the ejector half of the die was similar to that of the casting produced in the bare die shown in FIGS. 3A and 3B. The coating, however, was still present on the cover half of the die, and the microstructure of the casting adjacent to cover half did not contain the columnar region. The absence of the columnar zone indicates a lower cooling rate at the cover-die surface or, in other words, the coating retarded heat transfer. The microstructure of the casting adjacent to the cover half of the die is shown in FIG. 4B at a magnification of 500×.

It will be understood that the embodiments described above are merely exemplary and that persons skilled in the art make many variations and modifications. Such variations are intended to be within the scope of the invention as defined in the appended claims.

I claim:

1. A method for treating the surface of a steel casting die for molten metals which comprises:

(a) preparing a uniform dispersion consisting essentially of boron nitride powder, at least one elastomeric polymer having a high-polymer an a low-polymer fraction, and an organic solvent or diluent for the polymer;

(b) applying the dispersion as a film on the die surface which contacts the molten metal; and (c) allowing the film to dry to form a thermally insulating, lubricating and protective coating on the die surface.

2. The method according to claim 1 wherein the elastomeric polymer is selected from the group consisting of natural and synthetic rubbers, styrene butadiene rubber, butyl rubber, synthetic polyisoprene, polybutadiene rubber, chlorosulfonated polyethylene, polyacrylic rubber, nitrile rubber, polyurethane rubber and mixtures thereof.

3. The method according to claim 1 wherein the dispersion comprises about 1–2 parts by weight boron nitride powder to about 1–3 parts by weight elastomeric polymer, and a sufficient amount of solvent or diluent to provide a uniform dispersion.

4. The method according to claim 1 wherein the boron nitride powder has a particle size less than 200 mesh.

5. The method according to claim 1 wherein the coating thickness per application ranges from about 0.2 to 4.0 mils.

6. The method according to claim 1 wherein the molten metal is selected from the group consisting of zinc and zinc alloys.

7. The method according to claim 1 wherein the boron nitride powder is pre-coated with a solution of de-oiled lecithin in an organic solvent.

8. The method according to claim 7 wherein a 10% solution of de-oiled lecithin in an organic solvent selected from the group consisting of toluene, xylene and mineral spirits is used to pre-coat the boron nitride powder.

9. A coated casting die for molten metals which comprises a steel casting die having a uniform dry coating on the die surface which contacts the molten metal, said dry coating consisting essentially of boron nitride powder and at least one elastomeric polymer having a high polymer and a low-polymer fraction.

10. The casting die according to claim 9 wherein the elastomeric polymer is selected from the group consisting of natural and synthetic rubbers, styrene butadiene rubber, butyl rubber, synthetic polyisoprene, polybutadiene rubber, chlorosulfonated polyethylene, polyacrylic rubber, nitrile rubber, polyurethane rubber and mixtures thereof.

11. The casting die according to claim 9 wherein the dry coating consists essentially of about 1–2 parts by weight boron nitride powder to 1–3 parts by weight elastomeric polymer.

12. The casting die according to claim 9 wherein the boron nitride powder has a particle size less than 200 mesh.

13. The casting die according to claim 9 wherein the coating thickness ranges from about 0.2 to 4.0 mils.

14. The casting die according to claim 9 wherein the boron nitride powder is pre-coated with a solution of de-oiled lecithin in an organic solvent.

15. The casting die according to claim 14 wherein a 10% solution of de-oiled lecithin in an organic solvent selected from the group consisting of toluene, xylene and material spirits is used to precoat the boron nitride powder.

* * * * *

UNITED STATES PATENT AND TRADEMARK OFFICE

CERTIFICATE OF CORRECTION

PATENT NO. : 4,202,523

DATED : May 13, 1980

INVENTOR(S) : Schrade F. Radtke

It is certified that error appears in the above–identified patent and that said Letters Patent are hereby corrected as shown below:

First page of patent, Item [56], under "References Cited", the following references should be added:

-- U.S. PATENT DOCUMENTS

| | | | |
|---|---|---|---|
| 2,726,160 | 12/1955 | Ueltz | 252/363.5 |
| 2,923,041 | 2/1960 | Ryznar | 164/72 |
| 3,447,588 | 6/1969 | Niskovskikh et al | 164/73 |
| 3,620,290 | 11/1971 | Kress et al | 164/73 |
| 3,685,986 | 8/1972 | Rutes et al | 164/73 |
| 3,709,459 | 1/1973 | Bushrod | 249/134 |
| 3,727,666 | 4/1973 | Vander Sluis | 164/72 |
| 3,895,899 | 7/1975 | Weber et al | 425/378R |

FOREIGN PATENT DOCUMENTS

| | | | |
|---|---|---|---|
| 1555678 | 1968 | France | 427/133 |

OTHER REFERENCES

Chemical Abstracts, 89221t, Vol. 69, 1968 --.

UNITED STATES PATENT AND TRADEMARK OFFICE

CERTIFICATE OF CORRECTION

PATENT NO. : 4,202,523 Page 2 of 2

DATED : May 13, 1980

INVENTOR(S) : Schrade F. Radtke

It is certified that error appears in the above-identified patent and that said Letters Patent are hereby corrected as shown below:

Col. 4, line 23, "90% and 100%" should read -- 90% to 100% --; line 32, "and" should read -- or --; lines 52 and 53, delete "in the polymer material even when other fractions have already progressed" (duplication of previous two lines in patent). Col. 5, line 23, after "Wiley" insert -- & --; line 43, "ceramics of" should read -- ceramics or --. Col. 9, line 43, "polysioprene" should read -- polyisoprene --. Col. 11, line 3, "formulated" should read -- formulation --. Col. 12, line 44, "charring" should read -- charred --. Col. 13, line 60, after "increase" insert -- in --. Col. 14, line 66, "an" should read -- and --. Col. 15, line 14, "comprises" should read -- consists essentially of --.

Signed and Sealed this

*Twenty-third* Day of *September 198*

[SEAL]

*Attest:*

SIDNEY A. DIAMOND

*Attesting Officer* *Commissioner of Patents and Trademar*